United States Patent [19]

Crook

[11] Patent Number: 5,031,342

[45] Date of Patent: Jul. 16, 1991

[54] DEVICE FOR ENABLING WALKING AND PROTECTING CLEATS ON CYCLING SHOES FOR QUICK RELEASE (CLIPLESS) PEDALS

[76] Inventor: R. Igor Crook, P.O. Box 10361, Portland, Oreg. 97210

[21] Appl. No.: 447,658

[22] Filed: Dec. 8, 1989

[51] Int. Cl.[5] ..... A43B 5/00

[52] U.S. Cl. ..... 36/135; 36/7.5; 36/7.3

[58] Field of Search ..... 36/135, 7.5, 7.3, 127

[56] References Cited

U.S. PATENT DOCUMENTS

| | | | |
|---|---|---|---|
| 754,673 | 3/1904 | Mitchell | 36/135 |
| 817,977 | 4/1906 | Leibert | 36/135 |
| 2,032,052 | 2/1933 | Friedenberg | 36/135 |
| 3,020,654 | 2/1962 | McCann | 36/135 |
| 4,055,005 | 10/1977 | Meinhart | 36/135 |
| 4,693,019 | 9/1987 | Kim | 36/135 |
| 4,807,372 | 2/1989 | McCall | 36/135 |
| 4,872,273 | 10/1989 | Smeed | 36/135 |

*Primary Examiner*—Paul T. Sewell
*Assistant Examiner*—Ted Kavanaugh

[57] ABSTRACT

A device enabling walking in bicycling shoes fitted with cleats for clipless pedals and providing protection to the cleats while walking as well as elevating the heel to approximate walking shoes. The device anchors on the nose of the cleat and the heel box of the shoe, the elastic nature of the device and rigidity of the shoe sole serving to keep the device in place.

1 Claim, 3 Drawing Sheets

DEVICE FOR ENABLING WALKING AND PROTECTING CLEATS ON CYCLING SHOES FOR QUICK RELEASE (CLIPLESS) PEDALS

FIELD OF THE INVENTION

The present invention relates to shoes worn by bicyclists with clipless pedals, specifically shoes designed to attach to pedals without hand tightened straps.

BACKGROUND OF THE INVENTION

Bicycle enthusiasts have been motivated to use the upstroke of their legs for motive power and to be able to pedal at a fast rate. Over the years pedals have been equipped with metal or plastic clips to receive the toe of the shoe and strape to tightly hold the shoe.

Additional force could be exerted by using shoes that have a cleat that fits into the pedal with the strape tightened subsequently. This combination has very good efficiency, and the bicycle can be ridden with cleated cycling shoes, or less efficiently with normal walking shoes; but when the bicycle is ridden with cleated cycling shoes strapped into the pedals under toe clips, there is no way for the cyclist to remove his feet from the pedals without reaching down by hand and unbuckling the strape. This operation takes some time and can not be done while pedaling or with both hands on the controls of the machine and is considered dangerous in an emergency thus the cyclist is forced to choose between maximum efficiency and reasonable safety.

Recently there has been the development of clipless, quick release pedals that retain the shoe on the bicycle pedal by attaching to the cleat when the shoe is in its normal position, but allowing the cyclist to escape the pedal by moving the foot in some none pedaling direction. These pedals are considered an advance in safety, but typically do not allow conventional shoes to be worn at all when operating the bicycle, and the cleats are considerabely bigger than the cleats used formerly, so there is less load per square area, and the cleats are more slippery. Additionally, the cleats are a precision component that are sensitive to wear from contact with pavement and to clogging by earth or other matter. The location of the cleats on the shoe is very critical, often requiring skilled fitting using special equipment. Walking wears out the cleats requiring both the replacement of the cleat and the utilization of custom fitting.

The effect of these developments is to cause serious cyclists using clipless pedals to dedicate their riding to a portion of their life less integrated with other activities, and to carry other shoes if they contemplate having to walk because of mechanical failure or to enjoy any activity on foot.

Heretofore shoe covers have been developed to provide a walking surface for cleated cycling shoes by two basic methods. The first method consists of a cover which surrounds the toe of the shoe and the heel of the shoe and usually has a strap that is crossed over the top of the foot after the shoe is installed in the cover as in U.S. Pat. No. 4,055,005 to Meinhart, 1977. This cover is by its nature required to be approximately as large as the cycling shoe itself, require several different materials in its manufacture, hide the aesthetic design of the cycling shoe, and require relatively greater amounts of material and thus weigh more than other designs. Because it must cover the entire length of the cycling shoe it is necessarily larger and more difficult to store on the cyclist's person or bicycle and requires a greater range of sizes to fit on every size shoe.

The second method involves attaching permanently onto the shoe attaching devices for adding a walking sole, as in U.S. Pat. No. 4,807,372 to McCall, 1989 requiring the cyclist to alter his shoes and thus change the appearance of the shoe. This approach also increases the rotating weight when pedaling, which serious cyclists are always trying to reduce by developing lighter pedals, shoes, and crank components. There is on the market a product named Kool Kovers TM which encases the cleat only and provides as its object protection of the cleat from wear, it worsens the elevation of the sole of the shoe, provides no heel elevation, and has very little surface area for attachment and thus is subject to coming off in use.

OBJECTS AND ADVANTAGES

Accordingly, several objects of my invention are to provide a walking device that may attach to the shoe without altering the shoe in any fashion, which attaches to the front of the quick release cleat thus not requiring larger mass to encase the toe of the shoe, which requires only two points of anchor to stay on the shoe, which is worn on the shoe rather than over the shoe, which is lighter and more easily stored on a bicycle or cyclist's person than previous larger constructions, which fits a larger variety of shoe sizes because it spans only the cleat and heel rather than the entire shoe and which elevates the heel to a normal walking position using the thickness differential between the front portion and rear portion of the device.

Further objects and advantages of my invention will become apparent from a consideration of the drawings and ensuing description thereof.

DESCRIPTION OF THE PREFERRED EMBODIMENT

Figure 1:
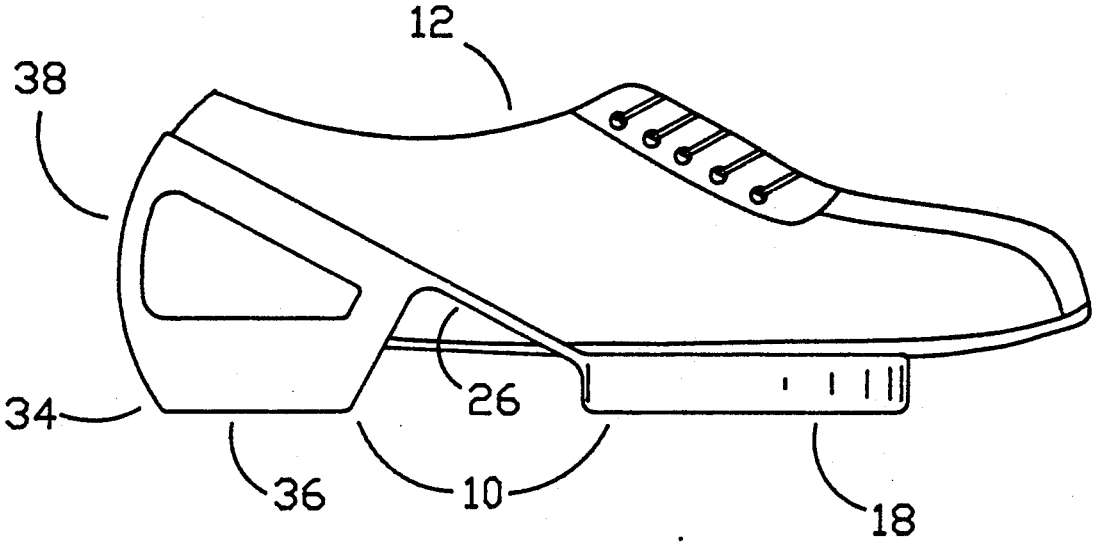
FIG. 1 is an elevational view of a cleated cycling shoe with the preferred form of the present invention attached.
Figure 2:
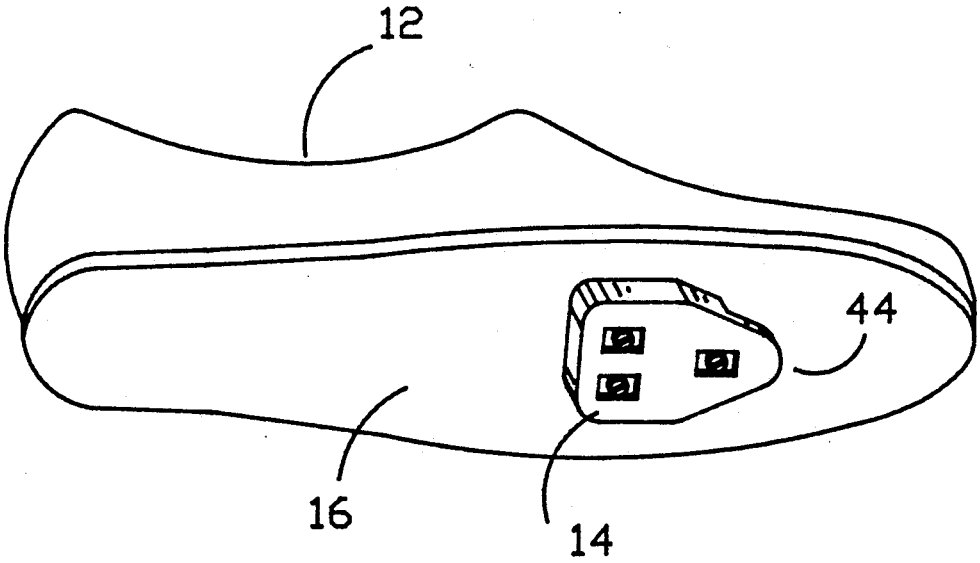
FIG. 2 is a perspective view of the bottom of a cleated cycling shoe and the quick release cleat.
Figure 3:
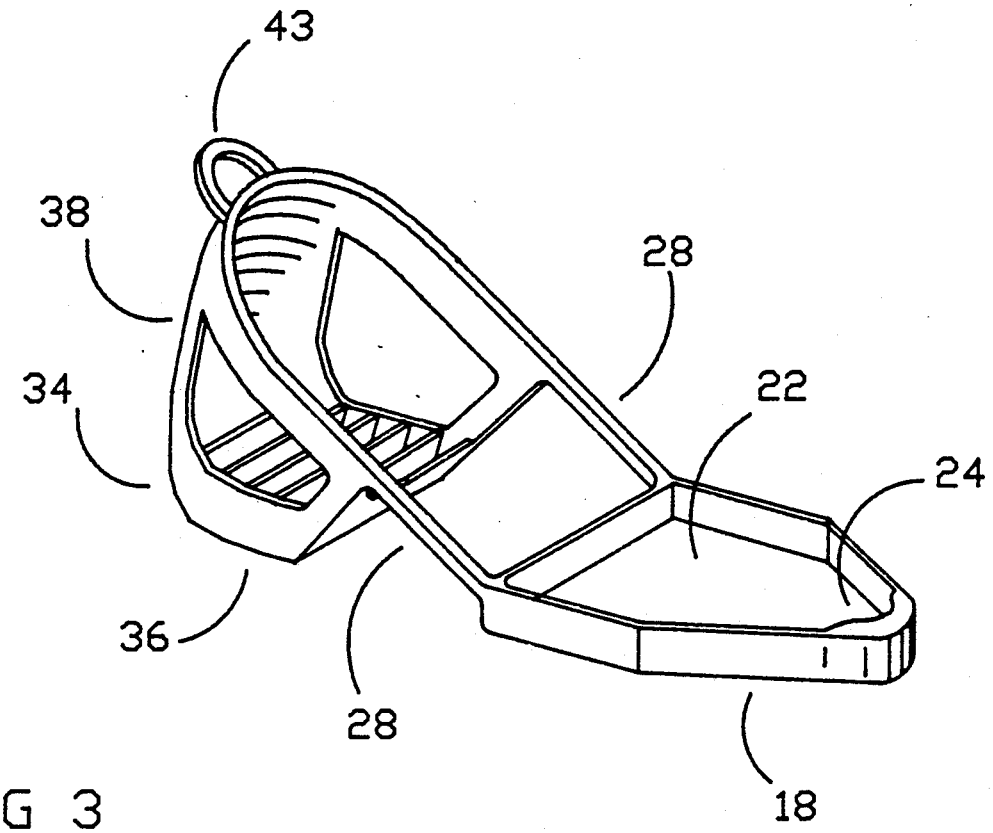
FIG. 3 is a perspective view of the top of the device showing the top of the device and its attaching points.
Figure 4:
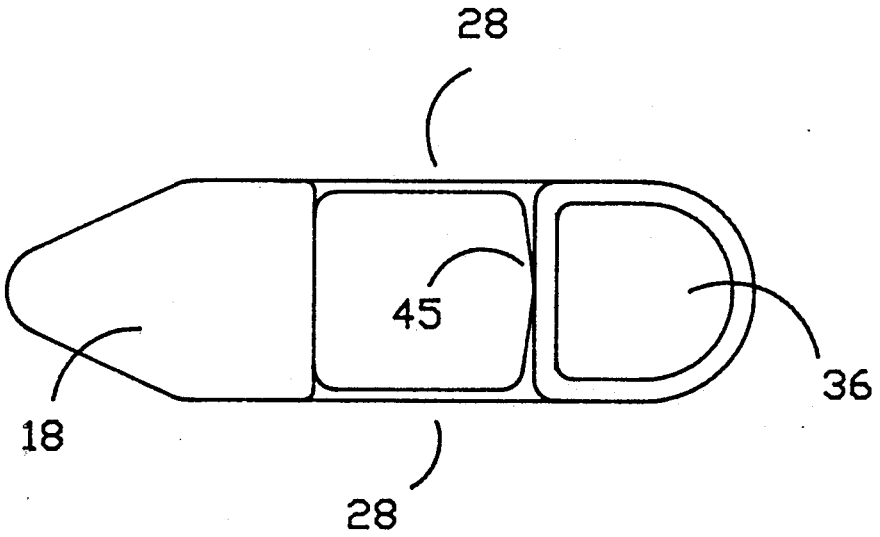
FIG. 4 is a plan view of the bottom of the device.
Figure 5:
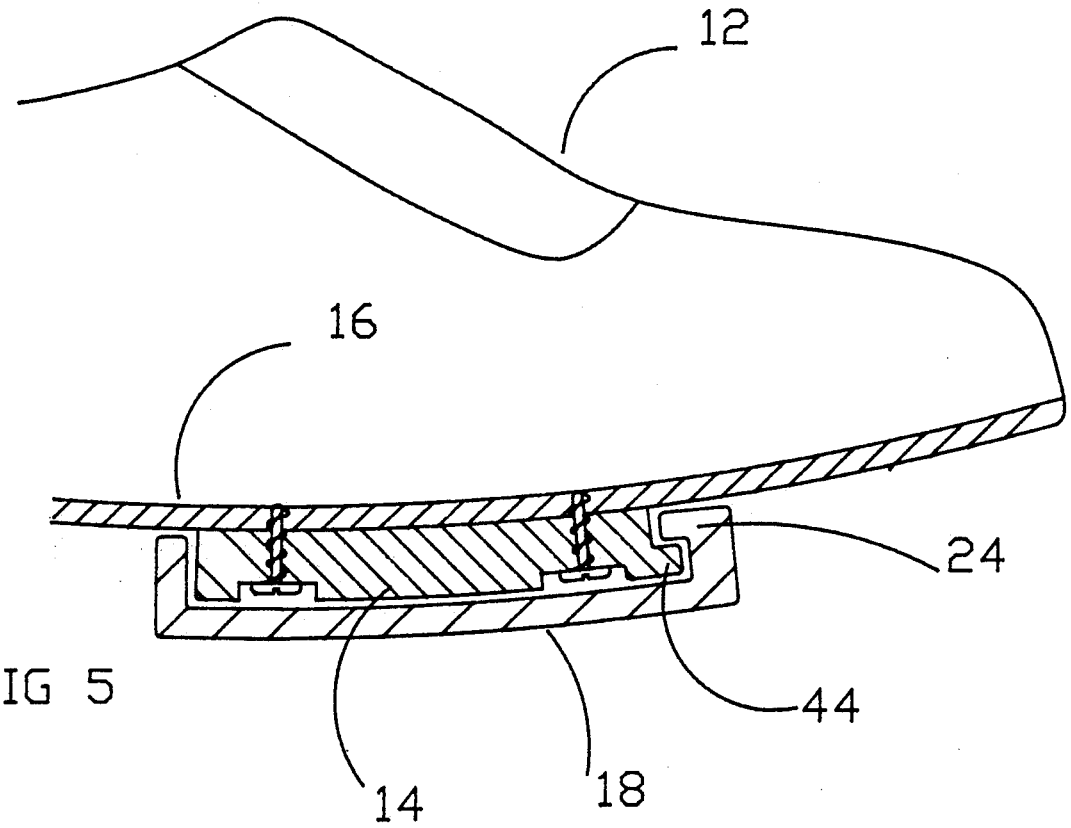
FIG. 5 is a sectional view showing the engagement of the front section of the device on the leading edge of the cleat, using a LOOK TM type cleat.
Figure 6:
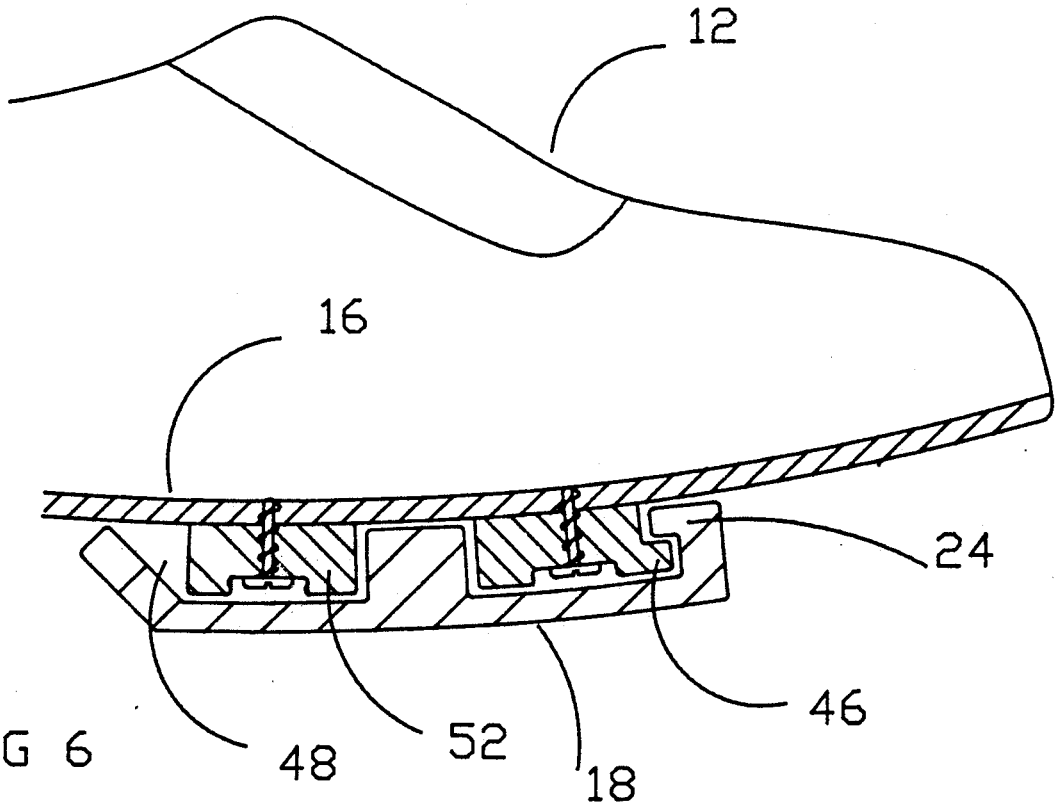
FIG. 6 is a sectional view showing the engagement of the front section of the device on the leading edge of a TIME TM type cleat showing a recess in the device front section for a portion of the TIME TM cleat.

Referring now to the above-described drawings in which like reference characters designate like or correspoondinng parts throughout the several views, the device 10 in accordandce with the present invention is illustrated in FIGS. 1–6. The device 10 is intended for use with a bicyclist's shoe 12 which includes a cleat 14 on the shoe sole 16 for attaching to a pedal having a structure for engaging the cleat. The cleat illustrated is of the clipless or quick release type sold under the trademark LOOK TM by Look Nevers Company of France and its licensees. It will be understood that the device is also usable with cleats for clipless pedals of other design having a rounded nose designed to engage a pedal having a transverse section engaging the top of the rounded nose of the cleat.

The device 10 has a front member 18 with a recess 22 large enough to receive the cleat 14. The front of the recess has a form corresponding to the rounded nose 44 of the cleat 14 in FIG. 5.

the device 10 has a front member 18 with a recess 22 large enough to receive the cleat 14. The front of the recess has a relief below the edge in the front of the recess parallel to the bottom of the device.

The device has a center member 26 which connects the rear member 34 to the front member 18. As the center member parts transition to the rear member they branch into the two portions of the rear member 38. The rear member is composed of a bottom portion 36 having a thickness greater than the material thickness of the front member 18 and its recess 22. There is also a part of the rear portion 34 that is a continuation of the center section and serves to connect them forming a loop of the material of the device, which is than connected to the rear member bottom portion 36 by a top to bottom connector 38.

In this embodiment there is a relief 42 in the bottom of the rear member, and a texture fabricated into the bottom surfaces of the front 18 and rear 34 portions of the device.

The entire device may be molded, as in this embodiment of a pliable material, although it could be assembled from separately made components, or made in any other fashion.

The device is used by anchoring the front of the device 22 onto the rounded nose of the cleat 14 stretching it onto the shoe by pulling on the rear portion 34 at the bottom relief 42 setting the loop 43 around the heel area of the shoe. This device can be installed on or removed from the shoe while the shoe is being worn.

The recess in the front portion of the device receives the cleat. The center section provides tension pulling the front and rear sections towards each other, and since the stiff, rigid cycling shoe does not flex the front and rear sections stay on their respective points of anchor. The thickness differential between front and rear sections when used in walking with a cycling shoe keep the walker's foot at an angle approximating normal stance. The device then allows the cyclist to walk properly.

When the cyclist is ready to ride the device is removed from the shoes and can be stored in a cycling jersey pocket or under the bicycle saddle or other convenient place.

While the above description contains many specificities, these should not be construed as limitations on the scope of the invention, but rather as an exemplification of one preferred embodiment thereof. Many other variations are possible, for example the front section can be changed in shape to accommodate any cleat for clipless pedals, and the rear section changed in thickness to accommodate changes in shoe fashion. If this device were used with the "Sampson TM" clipless pedal system the attaching point of the front section would be at the rear of the Sampson TM cleat. Accordingly, the scope of the invention should be determined not by the embodiment illustrated, but by the appended claims and their legal equivilents.

Having thus described my invention and the manner in which it may be used, I claim:

1. A walking device for a cycling shoe comprising:

(g) a front section specifically adapted to receive a bicycle shoe cleat for clipless pedals and surrounding said cleat on the sides and bottom and over the nose of cleat while said front section being sufficiently larger at the rear of to allow said cleat to enter the section and be engaged by a rounded nose of said cleat;

said front section comprising a recess in a front portion of said front section which engages with a rounded nose of said cleat;

(h) said front section being of a flexible and moldable material and serving to support the wearer's weight as transmitted through said cleat while serving as a traction surface and protective covering;

(i) a center section of said device serving as a tensioner and said tensioner consistng of two parts one on each side of said device, each part branching into upper and lower parts at a rear portion of said device, said tensioner acting as size adjustment for various size shoes;

(j) the rear portion of said device having said upper and lower parts, the said upper part having a looping of the said branching tensioner from said center section, and said lower part having a thickness greater than said front section to provide heel elevation for said cycling shoe;

(k) the upper and lower parts of said rear portion being connected by vertical members of like material serving to maintain the position of said upper part on the heel of the shoe.

(l) said device being quickly stretchable from an anchor point on said cleat nose to an anchor point of the heel.

* * * * *